United States Patent [19]

Tanikawa

[11] 4,368,631

[45] Jan. 18, 1983

[54] AUTOMATIC SETTING TOOL

[75] Inventor: Osamu Tanikawa, Toyohashi, Japan

[73] Assignee: USM Corporation, Farmington, Conn.

[21] Appl. No.: 280,940

[22] Filed: Jul. 6, 1981

[30] Foreign Application Priority Data

Jun. 25, 1980 [JP] Japan ..... 55-86258

[51] Int. Cl.[3] ..... B21J 15/34

[52] U.S. Cl. ..... 72/114; 72/391

[58] Field of Search ..... 72/114, 391

[56] References Cited

U.S. PATENT DOCUMENTS

| | | | |
|---|---|---|---|
| 2,753,072 | 7/1956 | Mitchell | 72/391 |
| 3,423,986 | 1/1969 | Young | 72/391 |
| 3,534,581 | 10/1970 | Mullen | 72/391 |
| 3,686,915 | 8/1972 | Miller | 72/391 |
| 3,838,588 | 10/1974 | Johnson | 72/114 |

FOREIGN PATENT DOCUMENTS

| | | |
|---|---|---|
| 2400287 | 7/1974 | Fed. Rep. of Germany . |
| 567586 | 2/1945 | United Kingdom . |

*Primary Examiner*—Gene Crosby

*Attorney, Agent, or Firm*—William F. White

[57] ABSTRACT

A fastener setting tool is disclosed for setting, to a panel member or the like, a fastener including an internally threaded nut portion, a tubular portion extending from the nut portion and a flange portion at the end of the tubular portion. The tool has a driving shaft, a nut member operatively connected to the shaft, a pulling rod threadably connected to the nut member and extending forward to the tool and a mandrel movably mounted to the end of the pulling rod with the end thereof having an externally threaded portion, and a half nut connected to the nut member so as to be rotated with the nut member and mounted on the externally threaded surface of the pulling rod under a predetermined binding force by a ring. The mandrel of the fastener setting tool is furthermore independently slidable with respect to the pull rod and is furthermore associated with a stop clutch which engages the mandrel when pushed back by a blind nut type of fastener so as to prevent further rotation.

11 Claims, 5 Drawing Figures

AUTOMATIC SETTING TOOL

FIELD OF THE INVENTION

The present invention relates to an automatic setting tool for a fastener, in particular, a tool for setting, to a panel member, a fastener including an internally threaded nut portion, a tubular portion extending from the nut portion and a flange portion at the end of said tubular portion.

BACKGROUND OF THE INVENTION

The fastener is set to a panel member in a manner that the tubular portion is inserted into the hole of the panel, and a pulling stem or mandrel having an external threaded end is screwed into the nut portion through the tubular portion. By pulling the mandrel while pressing the flange portion against the panel, the tubular portion is outwardly radially expanded at the rear side of the panel to secure the fastener to the panel. The secured fastener is used as a blind nut for another screw member.

An automatic fastener setting tool is shown in the Japanese Patent Publication No. 53-4674 in which the tool comprises a spindle operatively connected to a motor through reduction gear means, a nut member operatively connected to the spindle through clutch means, a pulling rod threadably connected to the nut member extending forward to the tool with the end thereof fixedly securing the mandrel which extends outwardly from a nose piece for threadably supporting the fastener to set it to the panel, and a specific coil spring between the nut member and the pulling rod. In the operation of this tool, when the spindle is rotated in the non-inverting or normal direction, the nut member is normally rotated via the clutch means to reduce the diameter of the coil spring between the nut member and the pulling rod to increase the frictional engagement force of the nut member and the pulling rod for rotation of the pulling rod. Then, the mandrel secured to the pulling rod is rotated so that the end thereof begins to be screwed into the internally threaded portion of the fastener mounted on the panel, and, by consequent rotation, the flange portion of the fastener presses the nose piece rearward to bring the rear end of the nose piece into frictional engagement with the end of the pulling rod to prevent the pulling rod from rotating. Thus, where the pulling rod is retracted rearward by a predetermined length, a projection of the pulling rod is engaged with a projection of the tool body to fully prevent the rod from rotating. The unrotated pulling rod is further retracted rearward while the tubular portion is expanded to complete the setting. Upon completion, a greater axial force is applied to the pulling rod so that the clutch elements between the nut member and the spindle begin to slide relative to each other so as to stop rotation of the nut member. In order to remove the mandrel from the fastener, the spindle is reversably rotated to connect the clutch means and reversably rotate the nut member. Then, the diameter of the coil spring is increased to decrease the engagement force between the nut member and the pulling rod. However, since the two different projections are engaged with each other and the pulling rod is into frictional engagement with the rear end of the nose piece after the projections have been disconnected, the pulling rod is returned forward without rotation and is moved until a stopper at the rear end of the pulling rod abuts against the nut member. On the abutment, there is no connection of the projections and no engagement of the pulling rod and the rear end of the nose piece, so that the pulling rod is reversely rotated together with the nut member and the mandrel also is reversely rotated so as to be removed from the fastener.

In the known setting tool, frictional engagement or disengagement between the nut member and the pulling rod is due to reduction or increase of the spring diameter by utilizing the helical spring. However, attainment of effective functions is limited to only a case where a precise clearance is provided between the inner diameter of the spring and the outer diameters of the pulling rod and the nut member, and it is almost impossible to obtain such a precise clearance. Even if it is provided, abrasion of the engagement portion of the spring which is always frictionally moved is very significant and the frictional engagement force is reduced in a short period of time. It is also difficult to maintain the frictional engagement force between the pulling rod and the rear end of the nose piece for a long period, so that the reversely rotated pulling rod cannot be returned to the foremost position while the projections are engaged with each other. Thus, immediately after the beginning of the next operation, the pulling rod is suddenly retracted, so that the normal operation of the setting tool cannot be expected. Rotation of both the pulling rod and the nut member is due to the frictional force by the reduced coil spring. However, as the frictional force is smaller than the torque for screwing the mandrel into the fastener, the mandrel is retracted from an uncompletely screwed condition to provide insufficient setting.

Another tool known in the prior art has a mandrel and a pulling rod with a reversably threaded surface. When a pulling load is appied to the pulling rod, the mandrel is retracted but not rotated by the rod, while under no pulling load, the mandrel is rotated to return to the front position.

This tool is disadvantageous in that the rotating connection between the mandrel and the pulling rod is retained from the beginning of the retraction and therefore, the mandrel is rotated and retracted, so that the threaded portion of the fastener is apt to be damaged and the mandrel is apt to be broken by torsional stress. The externally threaded portion of the pulling rod is not always engaged with the internally threaded portion of the tool body and the engagement and disengagement are always repeated, so that the threaded portions become damaged. It is usual to press the tool against the fastener upon the reversed rotation for removal of the tool from the fastener. In this case, there is a disadvantage that the pulling rod strikes on the end of the threaded portion of the tool body which will thereby be abraded or damaged.

OBJECT OF THE INVENTION

It is an object of the present invention to provide an automatic setting tool in which no specific coil spring is necessary, the mandrel is not rotated during its retraction and the pulling rod is always threadably connected to the nut member.

SUMMARY OF THE INVENTION

In order to achieve the above object, the present invention provides a fastener setting tool for setting, to a panel member or the like, a fastener including an internally threaded nut portion, a tubular portion extending from the nut portion and a flange portion at the end of the tubular portion, the tool comprising a driving shaft, a nut member operatively connected to the shaft, a pulling rod threadably connected to the nut member and extending forward to the tool and a mandrel removably mounted to the end of the pulling rod with the end thereof having an externally threaded portion. A feature of the setting tool is a half nut connected to the nut member so as to be rotated with the nut member. The half nut is mounted on the externally threaded surface of said pulling rod under a predetermined binding force by a ring. According to the present invention, the pulling rod is always connected to the nut member under the predetermined frictional force so that a specific coil is not necessary. In particular, the frictional force by the half nut is much greater than that of the coil spring so that the fastener is completely set. Further, since the frictional force is greater, no operation would ever arise in which the mandrel is retracted immediately after the beginning of the operation.

In the embodiment of the present invention, the driving shaft is operatively connected to the nut member through a first clutch consisting of two elements one of which can be axially slid on and rotated together with the driving shaft. The other element is mounted opposite to the first element and is to be rotated together with the nut member. The first clutch is formed in a manner that, when a predetermined anti-rotating force is applied to the nut member during rotation of the driving shaft, one of the clutch elements is slid on the engagement surface of the other while generating a click therebetween. By the click, the operator is able to know the end of the setting operation.

In another embodiment, a second clutch is provided between the pulling rod and the housing of a tool body. The second clutch comprises a first element connected to the pulling rod through a pin passing through an elongated slit on the portion of the end of the pulling rod and a second element slidably mounted on the outer surface portion of the pulling rod rearward to the first element through a pin extending into an elongated slit of the housing formed as a key groove, so that the elements are brought into engagement with each other only when the tool is pressed. The setting tool further includes a first spring for biasing the first element of the second clutch toward the end of said pulling rod, and a second spring for biasing the second element toward a nose of the tool. In particular, the elements of the second clutch have teeth such that, when both elements are partially engaged with each other during normal rotation of the pulling rod, both slide on each other when a predetermined value of torque is exceeded. When they are fully engaged, the engagement thereof is maintained even at the torque greater than the predetermined value. The teeth are also formed in a manner that, when both the elements are fully engaged with each other in the reversed rotation of the pulling rod to which a torque greater than the predetermined value is applied, both slide on their surfaces to generate the click. Such second clutch does not require any spring for returning the pulling rod and the clutch attains stabilized accurate operations for retraction and returning. Further, as the pulling rod and the mandrel are not rotated in their operations at all, the threaded portions of the fastener and the mandrel are not damaged.

It is preferred that the rear end of the mandrel be mounted to the end of the pulling rod so as to slide but not rotate with respect to the pulling rod. When the tool is pressed against the panel member or the like, the mandrel is moved rearward to press one element of the second clutch against the other element so as to prevent the pulling rod from rotating.

BRIEF DESCRIPTION OF THE DRAWINGS

The above and other features of the invention will now be particularly described with reference to the accompanying drawings, in which.

DESCRIPTION OF THE PREFERRED EMBODIMENT

A preferred embodiment of the present invention is described in detail hereinafter in conjunction with the aforementioned drawings. In a fastener setting tool embodying the present invention, housings for motor, gears and a spindle are integrally formed. The motor housing contains an air or electric motor, a trigger and a switch for exchanging the rotational direction of the motor in normal or reverse, and the gear housing receives a reduction gear mechanism therein. These structures are not further disclosed herein, but may be found in Japanese Patent Publication No. 53-4674.

Figure 1:
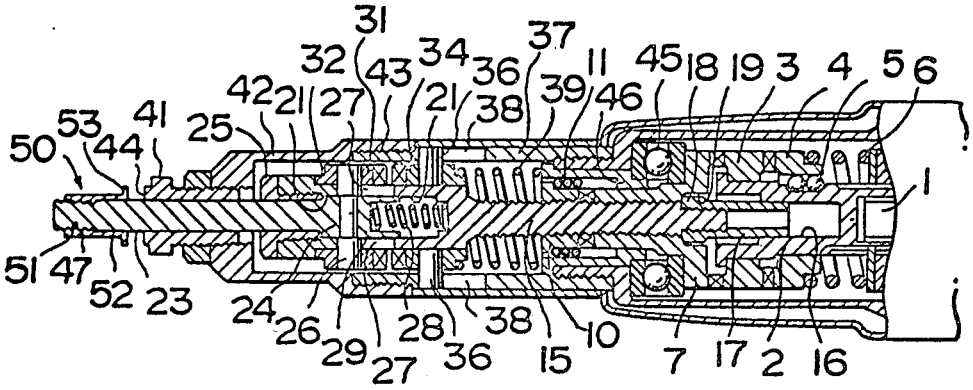
FIG. 1 is a side sectional view of the main portion of a fastener setting tool according to the present invention and showing the condition before the setting operation.

FIG. 1 shows a main portion of the setting tool according to the present invention. Driving shaft 1 is connected to a reduction gear mechanism which is not shown but is disposed at the right margin of FIG. 1. The reduction gear mechanism is rotated by a motor (not shown). A clutch shaft 2 is fittingly fixed to the driving shaft 1 so that rotation of the driving shaft 1 is transferred to the clutch shaft 2.

Two clutch elements 3 and 4 of a first clutch are axially juxtaposed on the outer surface of the clutch shaft 2. Steel balls 5 are placed between a part of the outer surface of the clutch shaft 2 and the opposed inner surface of the rear clutch element 4, so that the element 4 can be rotated with and axially moved on the clutch shaft 2. Spring 6 is disposed at the rear side of the clutch element 4 to normally bring the element 4 into engagement with the front clutch element 3. The biasing force of the spring 6 can be adjusted so that both the elements slide relative to each other under a torque of more than a predetermined value.

Figure 4:
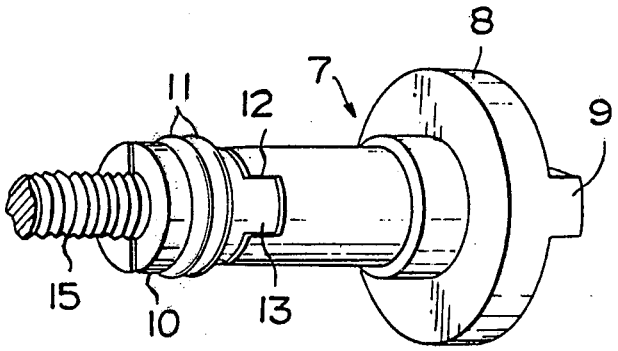
FIG. 4 is a partially perspective view showing the detail of the half nut as assembled.

The front clutch element 3 is rotatably and axially movably mounted on the clutch shaft 2. The surfaces of the clutch elements 3 and 4 are formed so that they slip relative to each other under a torque of more than a predetermined value in the normal rotation of the shaft. A reverse rotation of the element 4 is however transferred to the element 3 when the elements are thus engaged with each other. Nut member 7 is located at the front side of the front clutch element 3. The nut member 7 has a rear portion 8 of large diameter from which a projection 9 extends rearward as shown in FIG. 4. The element 3 facing the nut member 7 is provided with a recess for receiving the projection so as to operatively connect the nut member 7 to the clutch element 3. At the end of the nut member is mounted a half nut 10 having an internally threaded portion as continued to the threaded portion of the nut member. Resilient ring 11 is placed on the outer surface of the half nut 10 to form a nut of diameter smaller than the nut member 7. As shown in FIG. 4, the half nut 10 is connected to the nut member 7 by engagement between a recess 12 of the nut member 7 and a projection 13 of the half nut 10 so that the half nut can be rotated together with the nut member.

In the nut member 7 and the half nut 10 is mounted an externally threaded pulling rod 15 extending forward to the tool with the threaded portion screwed into the nuts 7 and 10. The pulling rod 15 has a rear end to which a stopper 17 is fixedly secured by, for example, screw means with the diameter allowing the axial movement in a bore 16 of the clutch shaft 2 and being larger than that of the pulling rod at the connecting portion. The large diameter portion 18 of the stopper 17 is received in a bore 19 of the nut member to prevent the pulling rod 15 from moving forward when the front side of the large diameter portion 18 abuts against the end of the bore 19. The intermediate portion of the pulling rod 15 is made of a rod member having an externally threaded surface to be threaded to the nut member 7 and the half nut 10. In particular, the half nut has a threaded portion of diameter decreased by the ring 11 so that the nut surface thereof is frictionally engaged with the surface of the pulling rod 15. Thus, a predetermined frictional force is always applied to the pulling rod 15 and the nut member 7, and the half nut is rotated with the nut member when no anti-rotational force above the frictional force is being applied to the pulling rod. The frictional force can be adjusted by a binding force of the ring 11. The suitable frictional force was observed as in the range of 5–8 kg. cm.

The front portion of the pulling rod 15 is formed in a slightly larger diameter in which bore 21 is made to receive a mandrel 23. More specifically, the bore 21 has a diameter to receive a large diameter portion 24 at the rear end of the mandrel 23. A cap 25 is threadably secured to the end of the bore 21. The cap 25 has a bore which is substantially the same as the diameter of the mandrel so as to permit the sliding of the cap on the mandrel. The mandrel is supported by the cap 25 in the pulling rod. The front portion of the pulling rod at the rear side of the cap 25 is provided with a pin 26 passing through the pulling rod and extending from the surface of the rod. The pin 26 extends into elongated slits 27 and 27 so as to be rotated together with the pulling rod 15 and moved in the axial direction of the rod by the slit length. In the bore 21 of the pulling rod is placed a spring 28 for biasing the pin 26 forward. The rear end of the mandrel 23 is provided with a recess (not shown) for receiving the pin 26 therein and the rear end portions other than the recess extend rearward substantially by the diameter of the pin. The mandrel 23 is connected to the pulling rod 15 through the cap 25, the stem of the pin 26 and the spring 28 so as to be rotated together with the rod. As shown in FIG. 1, pressing member 29 may be located at the front end of the spring 28 to press the pin (and the rear end of the mandrel) under a uniform force.

Figure 5:
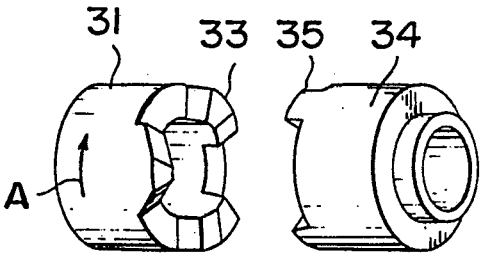
FIG. 5 is a perspective view of the elements of the second clutch.

Clutch element 31 is secured to the ends of the pin 26 to slide it on the surface of the pulling rod 15. The front end of the element 31 may be formed to press a shoulder 32 of the pulling rod 15 to thereby limit the forward movement of the pin 26. As shown in FIG. 5, engagement teeth of specific profile are formed at the rear end of the clutch 31. Another clutch element 34 is rotatably and slidably placed at the rear of the element 31 and on the pulling rod 15. These clutch elements 31 and 34 construct a second clutch. The surface of the element 34 facing the element 31 is provided with engagement teeth 35 of complementary profile to the teeth 33. The front end of the tooth 33 is tapered so that, when the clutch 31 is rotated in a direction as shown by arrow A in FIG. 5 by the normal rotation of the pulling rod 15 and when the clutch element 31 is brought into partial engagement with the other element 34, one is slid on the other. However, the remaining portion of the front end is so formed that, when the element 31 is further moved, the teeth 33 are fully engaged with the teeth 35. The rear end of the tooth is so tapered that when the clutch element 31 is reversely rotated, one element is slidingly engaged with the other element under the torque greater than a predetermined value. The rear clutch element 34 is provided with externally extending pins 36 and 36 of which each end is entered into each of second slits 38 and 38 formed on a tool housing 37. Thus, the element 34 can be axially moved on the pulling rod but cannot be rotated. Between the rear end of the element 34 and the rear portion of the tool housing is placed a spring 39 to bias the element 34 forward. The length of the slit 38 is so limited that, when the pulling rod 15 and the front clutch element 31 are at the respective foremost positions, the teeth of one of the clutch elements are not engaged with the others as shown in FIG. 1.

A cylindrical nose housing 42 is removably mounted on the tool body through an externally threaded portion 43 on the end of the housing 37. To the nose housing 42, a nose piece 41 in which the mandrel 23 extends from the end thereof is threadably connected. The nose housing 42 is removed when the mandrel 23 is attached to the end of the pulling rod 15, and after the mandrel 23 is attached by the cap 25 and the end of the mandrel is passed through the nose piece 41, the housing 42 is mounted on the body housing 37. The nose piece 41 at the end of the nose housing has an abutment surface 44 for a flange portion of the fastener and is threadably connected so that the distance between the surface 44 and the flange can be adjusted. Reference numeral 45 designates a ball bearing for freely rotating the nut member 7 from which nut member supporting projection 46 may extend radially inward to rotatably and slidably support the nut member 7.

Figure 2:
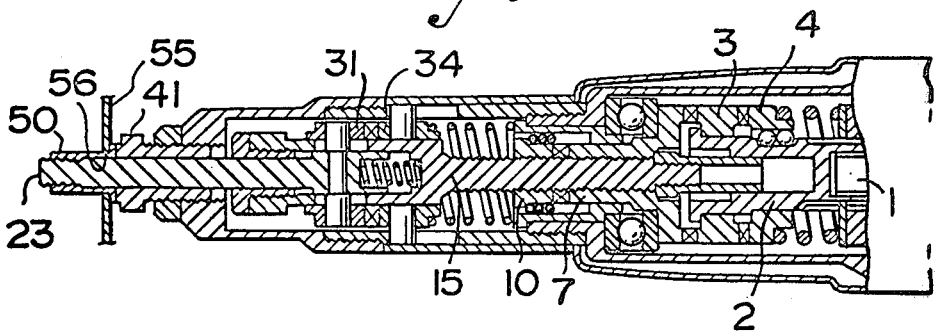
FIG. 2 is the same side sectional view as FIG. 1, but showing the beginning condition of the setting operation.
Figure 3:
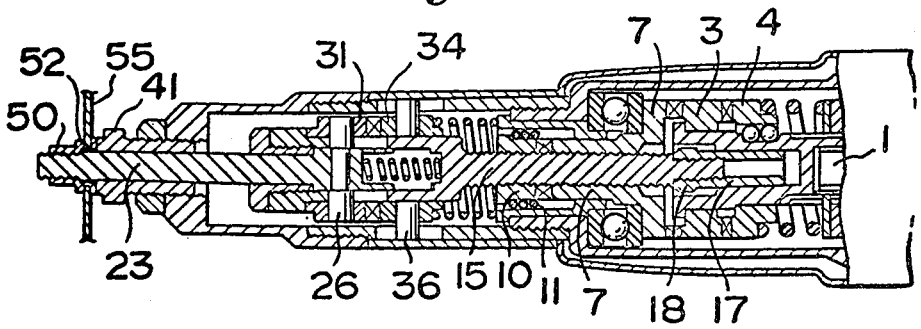
FIG. 3 is the same side sectional view as FIG. 1, but showing the end of the setting operation.

The fastener 50 as used comprises a nut portion 51, a tubular portion 52 and a flange portion 53. The tubular portion 52 can be expanded to set the fastener to a panel member 55 (FIGS. 2 and 3). The fastener is known as, the so-called blind nut.

In operation, referring to FIG. 1, the motor of the tool is rotated in the normal or non-inverting direction to normally rotate the driving shaft 1, the clutch shaft 2 and the rear element 4 of the first clutch. The first clutch elements 3 and 4 are engaged with each other to normally rotate the front clutch element 3 to transfer the rotation thereof to the nut member 7. When the nut member 7 is rotated, the half nut 10 is rotated in the same direction. Further, the pulling rod 15 is also rotated in the normal direction since the half nut 10 is frictionally engaged with the pulling rod under the predetermined frictional force by the ring 11. The pulling rod 15 is freely rotated because the front element 31 of the second clutch is not engaged with another element 34. The normal rotation of the pulling rod 15 causes the mandrel 23 at the end thereof to be rotated, so that the fastener 50 is threadably attached to the threaded portion 47 of the end of the mandrel 23 only by lightly pressing the fastener to the right hand side of FIG. 1. On completion of the attachment of the fastener 50 to the mandrel 23, clearance of a predetermined length is formed between the flange portion 53 and the front end of the nose piece 41, as shown in FIG. 1.

After attachment of the fastener 50 to the mandrel, the motor is deenergized and the tool is pressed against the panel member 55 to insert the fastener 50 into a hole 56 of the panel, as shown in FIG. 2. Thus, the mandrel 23 is moved rearward by the length of the clearance between the fastener flange and the end surface of the nose piece 41 thereby to bring the teeth of the front element 31 of the second clutch into engagement with the teeth of the rear element 34. Therefore, anti-rotating force greater than the frictional engagement force by the half nut 10 is applied to the pulling rod to prevent the pulling rod from being rotated. If the tool is insufficiently pressed toward the panel member 55 so as to not allow the flange of the fastener 50 to make contact with the end of the nose piece, the clutch element 31 is slid on the other element according to the specified tooth profile (FIG. 5) of which engagement force cannot overcome the frictional force of the half nut, so that the mandrel and the pulling rod continue their rotations. Therefore, the mandrel does not stop its rotation and does not retract rearward since the tool is not fully pressed to the panel member.

When the motor is normally rotated after the tool has been fully pressed against the panel member 55 as shown in FIG. 2, the half nut 10 and the nut member 7 are rotated relative to the unrotated pulling rod 15 to retract the rod rearward. According to the retraction of the pulling rod 15, the mandrel 23 is also retracted rearward to expand a portion of the tubular portion 52 of the fastener 50 radially outward to set the fastener to the panel member 55 as shown in FIG. 3. As shown in this drawing, after the fastener 50 has been set to the panel member 55, the mandrel cannot be further moved rearward, and then stopping torque is applied to the nut member 7. As mentioned above, the first clutch elements 3 and 4 begin to slide with each other when the stopping torque greater than the predetermined value is applied, and the click is generated by the slidingly engagement. Operator can notice the end of the setting.

After the setting, the motor is reversely rotated while the tool is still pressed. By the reverse rotation, the clutch elements 3 and 4 do not slide so as to transfer the reverse rotation of the shaft 1 to the nut member 7. On the other hand, the rotation of the pulling rod 15 is prevented by the second clutch and therefore, the reverse rotation of the nut member causes the pulling rod 15 and the mandrel 23 to be returned forward. When the mandrel 23 is returned to the foremost position, the large diameter portion 18 of the stopper 17 at the rear end of the pulling rod 15 abuts against the end of the bore 19 of the nut member 7 (FIG. 1) to limit further movement of the pulling rod 15, so that the pulling rod is rigidly fixed to the nut member to apply a high rotating torque to the pulling rod. In the reverse rotation, the elements 31 and 34 of the second clutch slide relative to each other under the torque greater than the predetermined value while generating the click. When the operator notices the click, he releases the pressing of the tool to the panel while maintaining the rotation of the mandrel to remove the mandrel from the fastener and then, the motor is deenergized.

In the present invention, the half nut and the resilient ring for binding the half nut are used to rotate the half nut together with the pulling rod under a predetermined frictional force at any time so that a coil spring is not necessary. The frictional force of the half nut is much greater than that of the coil spring and therefore, the frictional force of the half nut sufficiently overcomes the torque from the fastener to fully set the fastener. Further, since the frictional force is very high, no operation in which the mandrel is retracted at the beginning of the working would ever arise. The retraction of the mandrel does not start until the tool is fully pressed to attain a proper operation of the second clutch by which pulling rod returning spring is unnecessary. The mandrel does not rotate from the beginning to the end of the retraction at all and therefore, the threaded portions of the fastener and the mandrel are not damaged. The threaded portions of the pulling rod and the nut member are always engaged with each other so that the threaded portions are not damaged. The engagement of the second clutch elements is engaged by pressing the tool, and the attachment of the fastener to the mandrel is simple because the fastener is lightly pressed by operator's hand before the setting thereof to the panel member.

What is claimed is:

1. A fastener setting tool for setting, to a panel member or the like, a fastener including an internally threaded nut portion, a tubular portion extending from said nut portion and a flange portion at the end of said tubular portion, said tool comprising a driving shaft, a nut member operatively connected to said shaft, a pulling rod threadably connected to said nut member and extending forward to said tool and a mandrel removably mounted to the end of said pulling rod with the end thereof having an externally threaded portion, a half nut connected to said nut member so as to be rotated with said nut member and mounted on the externally threaded surface of said pulling rod under a predetermined binding force by a ring.

2. The setting tool of claim 1 wherein said driving shaft is operatively connected to said nut member through a first clutch consisting of two elements, one of which can be axially slid on and rotated together with the driving shaft and the other being mounted opposite to said one element so as to be rotated together with said nut member, and said first clutch is formed in a manner that, when a predetermined anti-rotating force is applied to said nut member during rotation of the driving shaft, said one of the clutch elements is slid on the engagement surface of the other while generating a click therebetween.

3. The setting tool of claim 1 or 2 including a second clutch consisting of second clutch elements located between said pulling rod and a housing of the tool body and disposed so as to bring said second clutch elements into engagement with each other only when the tool is moved toward the panel member.

4. The setting tool of claim 3 wherein said second clutch includes a first element connected to said pulling rod through a pin passing through an elongated slit on an end portion of said pulling rod, and a second element slidably mounted on the outer surface portion of said pulling rod rearward to said first element through a pin extending into an elongated slit of said housing formed as a key groove.

5. The setting tool of claim 4 including a first spring for biasing said first element of said second clutch toward the end of said pulling rod, and a second spring for biasing said second element toward a nose of the tool.

6. The setting tool of claim 4 wherein said first and second elements of said second clutch have such teeth that, during rotation of said pulling rod, both the elements when partially engaged with each other begin sliding engagement above a predetermined torque but when fully engaged, maintain the engagement even when the torque greater than said predetermined value is applied.

7. The setting tool of claim 4 wherein said first and second elements of said second clutch have such teeth that, when both the elements are fully engaged with each other during reverse rotation of said pulling rod to which a torque greater than a predetermined value is applied, the elements are slid on their surfaces to generate a click.

8. The setting tool of claim 3 wherein said mandrel has a rear end mounted to the end of said pulling rod to be slid but not rotated with respect to said pulling rod.

9. A blind rivet nut setting tool comprising a housing having a nose piece for engagement with the head of a rivet, a pull bar rotatably and axially reciprocably mounted in the housing, a friction nut in mesh with an external thread of the pull bar so that rotation of the nut results in rotation of the pull bar up to the limit of said friction and in retraction of the pull bar when such limit is exceeded, power operated means for rotating the nut, a mandrel coupled to rotate with the pull bar but reciprocable relative thereto, and a clutch member non-rotatable in the housing but axially retractable against spring pressure by which it is normally held in a forward position against stop means of the housing, the clutch member when in its forward position being lockingly engaged upon retraction of the mandrel by a complementary member adjacent the mandrel, which is normally held by spring means in an advanced position out of engagement with the clutch member, retraction of the mandrel when bringing together the nose piece and a rivet threaded a short way along the mandrel thus resulting in the mandrel becoming locked against rotation by engagement with the clutch member and consequently the limit of said friction being exceeded and setting of the rivet being initiated.

10. A tool according to claim 9 in which the mandrel is threaded for only a short distance from its tip to limit approach of the rivet towards the nose piece when it is initially threaded on the mandrel.

11. A tool according to claim 10 in which the nose piece is adjustable axially on the housing.

* * * * *